US007891848B2

(12) United States Patent
Sperling

(10) Patent No.: US 7,891,848 B2
(45) Date of Patent: Feb. 22, 2011

(54) LIGHTING ASSEMBLY AND RELATED METHODS

(75) Inventor: Jacob Sperling, Los Angeles, CA (US)

(73) Assignee: Maxim Lighting International, Inc., Industry, CA (US)

( * ) Notice: Subject to any disclaimer, the term of this patent is extended or adjusted under 35 U.S.C. 154(b) by 253 days.

(21) Appl. No.: 12/324,587

(22) Filed: Nov. 26, 2008

(65) Prior Publication Data

US 2010/0128492 A1 May 27, 2010

(51) Int. Cl.
*F21V 21/096* (2006.01)

(52) U.S. Cl. ..... 362/398; 362/405; 362/457; 362/806

(58) Field of Classification Search ..... 362/398, 362/457, 806, 441–442; 248/309.4, 206.5, 248/683, 537; D26/24; 24/303
See application file for complete search history.

(56) References Cited

U.S. PATENT DOCUMENTS

| | | | | |
|---|---|---|---|---|
| D440,692 | S | 4/2001 | Janos et al. | |
| D452,340 | S | 12/2001 | Pickett et al. | |
| 6,565,234 | B1 | 5/2003 | Skegin et al. | |
| 7,114,833 | B1 | 10/2006 | Pickett et al. | |
| 7,217,014 | B2 * | 5/2007 | Nielson | 362/405 |
| D570,038 | S | 5/2008 | McDowell | |
| 7,384,170 | B2 | 6/2008 | Skegin | |
| 2008/0030983 | A1 | 2/2008 | Pickett et al. | |
| 2008/0170390 | A1 | 7/2008 | McDowell | |
| 2008/0298076 | A1 | 12/2008 | Skegin | |

OTHER PUBLICATIONS

Co-pending Design U.S. Appl. No. 29/330,942, filed Jan. 16, 2009.
Co-pending Design U.S. Appl. No. 29/330,941, filed Jan. 16, 2009.
Co-pending Design U.S. Appl. No. 29/330,940, filed Jan. 16, 2009.
Co-pending Design U.S. Appl. No. 29/330,930, filed Jan. 16, 2009.
Co-pending Design U.S. Appl. No. 29/330,933, filed Jan. 16, 2009.
Co-pending Design U.S. Appl. No. 29/330,938, filed Jan. 16, 2009.
Co-pending Design U.S. Appl. No. 29/330,939, filed Jan. 16, 2009.
Co-pending U.S. Appl. No. 12/401,290, filed Mar. 10, 2009.
Co-pending Design U.S. Appl. No. 29/333,842, filed Mar. 16, 2009.

* cited by examiner

*Primary Examiner*—Jong-Suk (James) Lee
*Assistant Examiner*—Robert J May
(74) *Attorney, Agent, or Firm*—Bracewell & Giuliani LLP

(57) ABSTRACT

A lighting assembly and associated methods are provided. An example of an embodiment of a lighting assembly includes a lighting fixture base and a plurality of elongate decorative elements each having a male fitting connected to the proximal end portion of the decorative elements. The attached male fittings, formed of a ferromagnetic material, are each configured to be inserted into a female fitting. The lighting assembly also includes a corresponding plurality of female fittings each connected to separate portions of the lighting fixture base. Each female fitting can include a magnet positioned within a portion of a male fitting-receiving recess, adjacent the proximal end portion of the female fitting. The combination of male and female fittings is such that when inserted into a female fitting, each male fitting is magnetically coupled to one of the female fittings to releasably connect its associated decorative element to the lighting fixture base.

22 Claims, 7 Drawing Sheets

45
47
41
43
51
71
73
53
63
68
65
61
39
37
69

75
73
53
68

53
73
51
71
79
63
53
65
73
61
68
69
67

LIGHTING ASSEMBLY AND RELATED METHODS

BACKGROUND OF THE INVENTION

1. Field of the Invention

The present invention relates generally to lighting systems. More specifically, the present invention relates to lighting assemblies having decorative attachments or other elements and methods of assembling lighting assemblies having decorative elements.

2. Description of the Related Art

Various types of lighting fixtures and other lighting assemblies include surface mounted, table mounted, pendant, cove, ceiling-mounted, etc, lighting assemblies with the chandelier being one of the most beautiful and possibly the most fragile lighting assembly.

The more elegant lighting fixtures and other lighting assemblies, such as the chandelier, utilize decorative elements that add beauty to the lighting assembly and function to help manage distribution of light through reflection or refraction of the light emanating from the individual light sources (e.g., light bulbs). The chandelier, in particular, includes a fixture base including multiple arms, which, in turn, each generally have at least one light source highlighted or otherwise enhanced by multiple decorative elements.

These decorative elements can take various forms, to include beads, bobeches, leafs, etc. which can be made, for example, from fragile materials including glass and lead crystal. Although a desired feature which provides elegance to the lighting assembly, these decorative elements are easily damaged, and thus, can be a frequent source of customer complaints, and a source of frustration for both the shipper/manufacturer and the customer.

For example, when the entire lighting assembly is shipped preassembled, one or more of the decorative elements are often broken or damaged during shipment, particularly when the decorative elements are attached to extended arms of the fixture base. The delicateness of some of the decorative elements, particularly crystal leaves, for example, has led many shippers/manufacturers to either connect the decorative elements to the arms of the fixture base of the lighting assembly using a collapsible mechanism, or to pre-wrap the decorative elements individually for shipment, and require assembly upon arrival at the destination, either by agents of the shipper or manufacturer, or by the customer.

The use of a collapsible mechanism, or use of various other spring-type connection devices, for that matter, whether pre-installed, or provided for post-delivery installation, often proves inadequate due to difficulties in adjusting spring tension, the tendency to wear out, an excessive stiffness in the springs, or a lack of sufficient stiffness—resulting in a "wilting" of the leaves. Providing mechanical fasteners and requiring assembly by agents of the shipper or manufacturer, on the other hand, although likely providing an enhanced perception of value, can substantially add to the cost of the lighting assembly.

In contrast, requiring the customer to assemble the lighting assembly, him/herself, when tools are required to perform the assembly, can result in a reduced perception of value. That is, customers generally expect to receive fragile items separately, and expect to have to separately position ornamental or decorative elements of a fragile nature, by band, on the arms of the lighting assembly—not really considering this to fall under the category of "some assembly required." The same customers, however, may be hostile to the requirement for actually using mechanical tools to install the decorative elements, and may not understand how to properly do so, or may damage the decorative elements during installation if not accomplished properly. Further, the customer performing tire assembly may find great difficulty in properly aligning the decorative elements, which can reflect poorly on both the quality of the specific lighting assembly being assembled, and on the particular type of lighting assembly, in general, as the poorly assembled fixture may result in a negative advertisement of that particular lighting assembly product or product line. Such can result in a significant loss of sales.

Additionally, the decorative elements typically require removal for proper cleaning. The use of tools or the requirement to disconnect complicated mechanical components can, however, result in damage to the decorative elements during the removal or cleaning, and can result in improper reinstallation and/or damage during reassembly after removal for cleaning.

Recognized by the inventors, therefore, is the need for lighting assemblies including a fixture base and multiple decorative elements, particularly fragile elements: which can be individually and securely packaged to prevent shipping damage; which do not require attachment to the fixture base via complicated mechanical components prone to maladjustment and/or prone to wearing out over time; which do not require tools for assembly or disassembly; and which can be readily aligned in the proper position.

SUMMARY OF THE INVENTION

In view of the foregoing, various embodiments of the present invention advantageously provide lighting assemblies including a fixture base and multiple decorative elements, which do not require attachment to the fixture base via complicated mechanical components prone to maladjustment and/or prone to wearing out over time. Advantageously, according to various embodiments of the present invention, the decorative elements attachment, mechanism is such that the individual decorative elements can be individually and securely packaged to prevent shipping damage, and then readily unpackaged and easily and accurately positioned, e.g., readily aligned in the proper position without the need for mechanical tools.

More specifically, an example of an embodiment of the present invention provides a lighting assembly including a lighting fixture base, and a plurality of elongate decorative elements each having a male fitting connected to the proximal end portion of the decorative elements. The main body of each decorative element is typically constructed from a relatively fragile material which is readily susceptible to breakage during shipment if connected to the lighting fixture base, and which is readily susceptible to breakage during cleaning, particularly tools are required to separate the decorative elements from the lighting fixture base. The attached male fitting, on the other hand, configured to be inserted into a female fitting carried by the lighting fixture base, includes a relatively non-fragile ferromagnetic material. The lighting assembly can also include a corresponding plurality of female fittings each connected to separate portions of the lighting fixture base. The distal end portion and the medial portion of each female fitting can each include portions of a recess configured to receive substantial portions of one of the male fittings. Each female fitting can include a magnet positioned within the respective recess, for example, adjacent the proximal end portion of the female fitting.

Further, according to this example of an embodiment of a lighting assembly, the decorative elements can be separately packaged, during delivery for assembly at the destination. As such, the combination of male and female fittings is such that after removal from the packaging, each male fitting can be inserted into a female fitting such that each male fitting, when inserted therein, is magnetically coupled to a female fitting to releasably connect its associated decorative element to the lighting fixture base.

Still further, each male fitting can include either an alignment key/slot mated with a corresponding alignment slot/key positioned along at least portions of the inner surface portion of the female fitting which defines the respective male fitting-receiving recess. The alignment slot-key combination advantageously can ensure that the decorative element is properly aligned according to the artistic design of the lighting assembly when either inserted into the female fitting during initial assembly, or during reassembly after being removed for cleaning, etc.

Another example of an embodiment of the present invention provides a lighting assembly including a decorative element having a proximal end portion including a first fitting connected thereto and formed of a ferromagnetic material, and a lighting fixture base including a second fitting connected thereto and including a recess configured to receive at least portions of the first fitting. The second fitting carries a magnet positioned to magnetically couple the second fitting with the first fitting when the first fitting is inserted into the recess of the second fitting to thereby releasably connect the decorative element to the fixture base. A decorative skirt can contain at least portions of the proximal end portion of the decorative element and at least portions of the distal end portion of the first fitting to maskingly interface the decorative element with the first fitting. Further, each male fitting can include either an alignment key/slot mated with a corresponding alignment slot/key positioned along at least portions of the inner surface of the female fitting which defines the respective male fitting-receiving recess.

Another example of an embodiment of the present invention provides a lighting assembly including a decorative element, a first fitting connected to the proximal end portion of the decorative element and formed, e.g., of a ferromagnetic material, and a second fitting configured to be connected to a lighting fixture base and including a recess configured to receive at least portions of the first fitting. The second fitting carries a magnet positioned to magnetically couple the second fitting with the first fitting when the first fitting is inserted into the recess of the second fitting to thereby releasably connect the decorative element to the fixture base.

Embodiments of the present invention also include a method of forming a lighting assembly. An example embodiment of such a method can include the steps of providing one or more decorative elements connected to or otherwise including a male fitting formed of a ferromagnetic material, providing a fixture base containing, connected to, or otherwise including a female fitting having a recess carrying a magnet configured to receive the male fitting, and inserting the male fitting of the decorative element into the recess of the female fitting to releasably magnetically couple the decorative element to the fixture base. If one or more of the male fittings include an alignment key and one or more of the female fittings include an alignment slot, the step of inserting the male fitting into the recess of the female fitting can include aligning the alignment key of the male fitting with the alignment slot of the female fitting to orient the decorative element in a preselected orientation. Alternatively, if one or more of the male fittings include an alignment slot and one or more of the female fittings include an alignment key, the step of inserting the male fitting into the recess of the female fitting can include aligning the alignment slot of the male fitting with the alignment key of the female fitting to orient the decorative element in the preselected orientation.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may; however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

Figure 1:
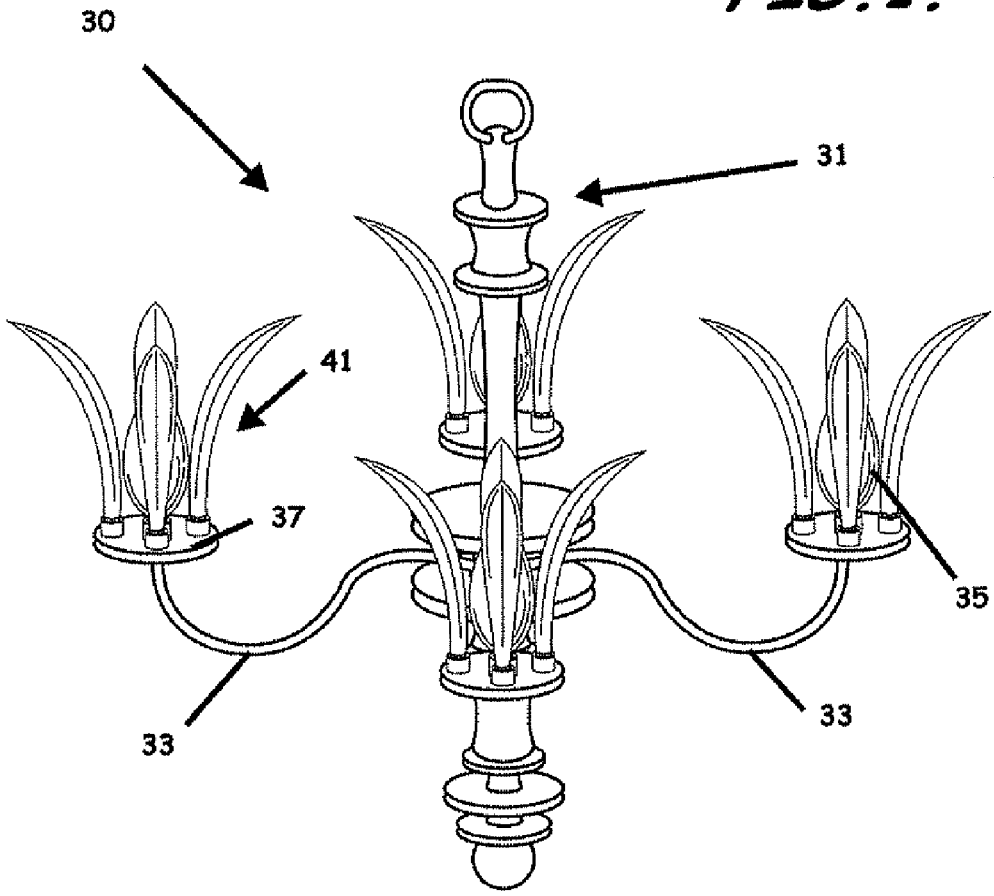
FIG. 1 is a perspective view of a lighting assembly according to an embodiment of the present invention.

FIG. 1 illustrates a lighting assembly 30 according to an example of an embodiment of the present invention. The lighting assembly 30 can include a lighting fixture base 31 including at least one, but more typically, multiple arms 33 according to one of various configurations known to those skilled in the art. Each arm 33 can either individually or separately carry a lighting source 35, e.g., light bulb or other source known to those skilled in the art, a connection platform 37, and one or more decorative elements 41, such as, for example, beads, bobeches, leafs, etc., just to name a few, which can be used to add beauty to the lighting assembly 30 and help manage distribution of light through reflection or refraction of light emanating from the individual light sources 35 (e.g., light bulbs). Note, it should be understood that lighting sources 35 can also be positioned on other parts of the lighting fixture base 31 besides that of the arms 33.

Figure 2:
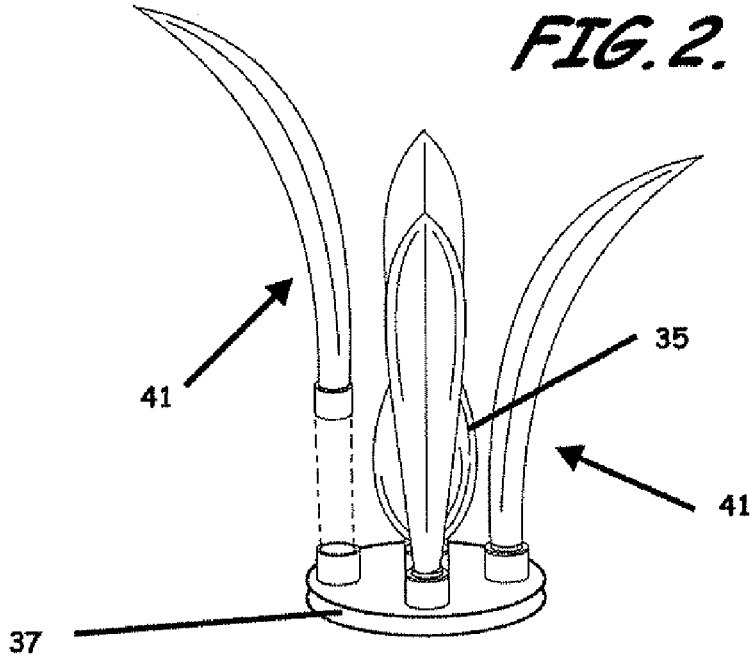
FIG. 2 is a perspective view of a connection platform of an arm of a fixture base of the lighting assembly of FIG. 1 carrying decorative elements, one partially exploded, according to an embodiment of the present invention.

As further illustrated in FIG. 2, one or more of the arms 33 can include a connection platform 37 according to one of various shapes or configurations known to those skilled in the art, to carry either or both of the lighting source 35 and the decorative elements 41, which are typically made, for example, from fragile materials including glass and/or lead crystal, etc., and which are normally connected to be oriented in an aesthetically pleasing manner.

Figures 3, 4, 5, 6:
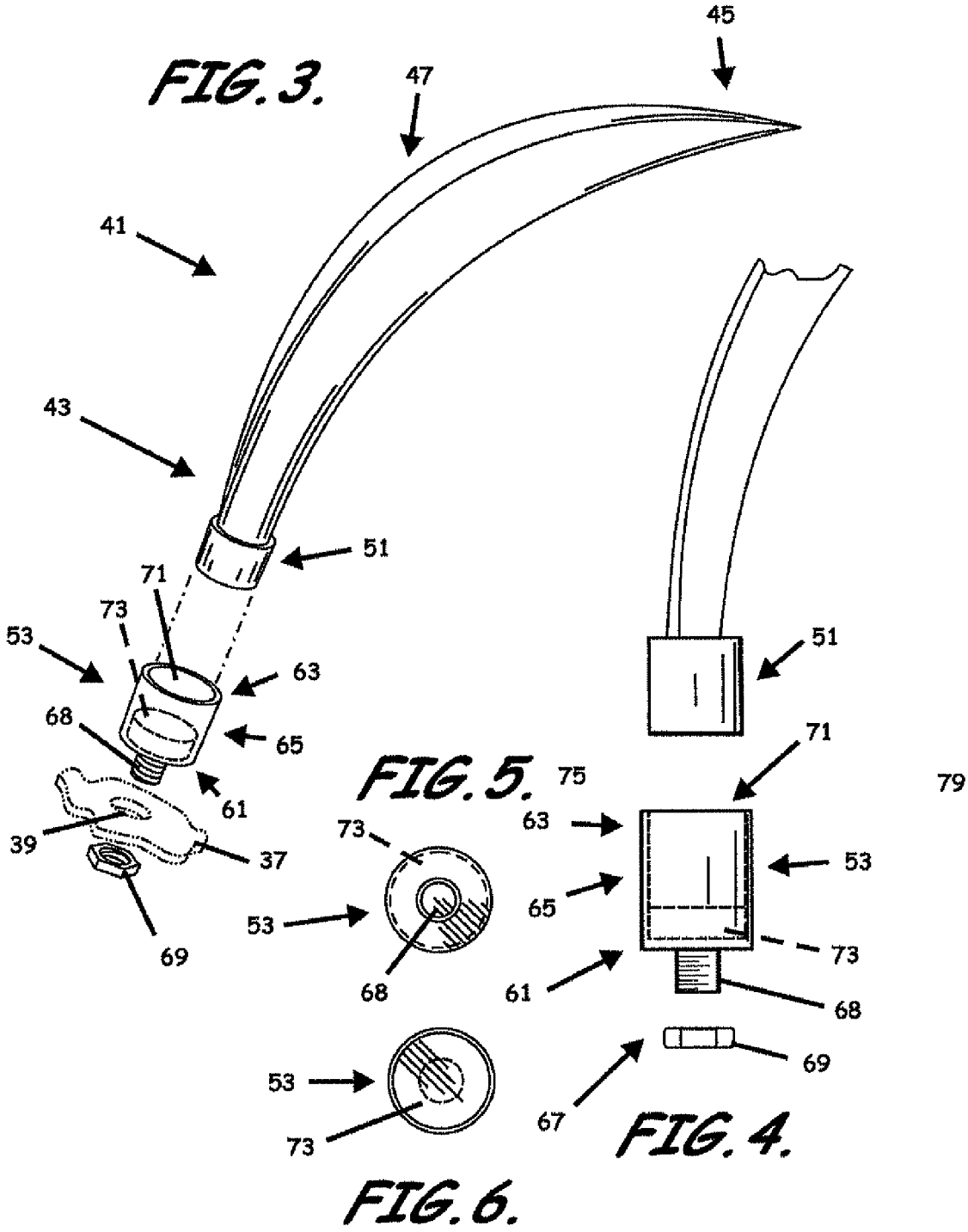
FIG. 3 is a partially exploded perspective view of a decorative element of FIG. 1 according to an embodiment of the present invention.
FIG. 4 is a partially exploded perspective view of tire decorative element of FIG. 1 according to an embodiment of the present invention.
FIG. 5 is a top perspective view of the female fitting shown in FIG. 3 prior to connection of a magnet therein according to an embodiment of the present invention.
FIG. 6 is a bottom perspective view of the female fitting shown in FIG. 3 according to an embodiment of the present invention.

As shown in FIGS. 3-6, each decorative elements 41, according to the exemplary embodiment of the present invention shown in FIG. 1, can having a proximal end portion 43, a distal end portion 45, a medial portion 47 extending therebetween, which can be relatively short, or relatively elongate, as shown by the leaf design illustrated, for example, in FIG. 3. According to this example, the proximal end portion 43 of each decorative element 41 carries or is otherwise connected to or interfaced with a male fitting 51. Correspondingly, each connection platform 37 of the lighting fixture base 31 can carry or otherwise interface with one or more female fittings 53, typically along separate portions of the platform 37, to arrange the decorative elements 41 in an aesthetically pleasing manner.

Each female fitting 53 can include a proximal end portion 63, a distal end portion 63, and a medial portion 65 extending therebetween. The proximal end portion 61 of the female fitting 53 can carry a fastener assembly 67, e.g., threaded nipple 68 and nut 69, or other fastening means known to those skilled in the art, which in the illustrated configuration, can extend into and be hidden by the surface and body of the connection platform 37. In the illustrated example, the threaded nipple 68 having a diameter equal to or less than an aperture 39 in the connection platform 37, which has a diameter less than the diameter of the male fitting 51, can extend through the aperture 39 in the connection platform 37 and be clamped to the surface of the connection platform via a nut 69 or other intermediate device (not shown) which can have a diameter exceeding that of the aperture 39.

The distal end portion 63 and the medial portion 65 of each female fitting 53 can include portions of a recess 71 configured to receive a male fitting 51. Correspondingly, each male fitting 51 is configured to be inserted into one or more of the female fittings 53. According to a preferred configuration, each male fitting 51 can be sized to slide into the recess 71 of one or more of the female fittings 53 to form, e.g., a substantially tight connection. Note, the male fitting 51 can be of any desired shape that will fit within the recess 71 of the female fitting 53. There are, however, benefits of configuring the male fitting 51 and recess 71 to have a cylindrical shape.

According to the illustrated example, each recess 71 of each female fitting 53 can contain a magnet 73 typically positioned adjacent the proximal end portion 61 of the fitting 53, and each male fitting 51 can at least partially, if not completely, include a ferromagnetic material (e.g., iron or steel, cobalt, nickel, etc., or alloys thereof) so that when the male fitting 51 is inserted into the recess 71 of the female fitting 53, the male-female combination forms a magnetic coupling sufficient to releasably connect the decorative element 41 to the connection platform 37 of the lighting fixture base 31. Note, as with the previously described exemplary embodiments of the present invention, it should be understood that rather than positioning the magnet 73 in the recess 71 of the female fitting 53, as illustrated, the magnet 73 can be positioned at other locations. For example, the magnet 73 can be connected to the proximal end portion 61 of the fitting 53 outside of the recess 71, if sufficiently strong enough to penetrate through the female fitting 53 and if the female fitting 53 is also made of a ferromagnetic material, or if not made of such material, sufficiently strong to penetrate through the female fitting 53. Additionally, magnet 73 can instead be positioned axially in contact with the proximal most surface 75 of the male fitting 51, and configured to be received by the recess 71 (configuration not shown).

Figure 7:
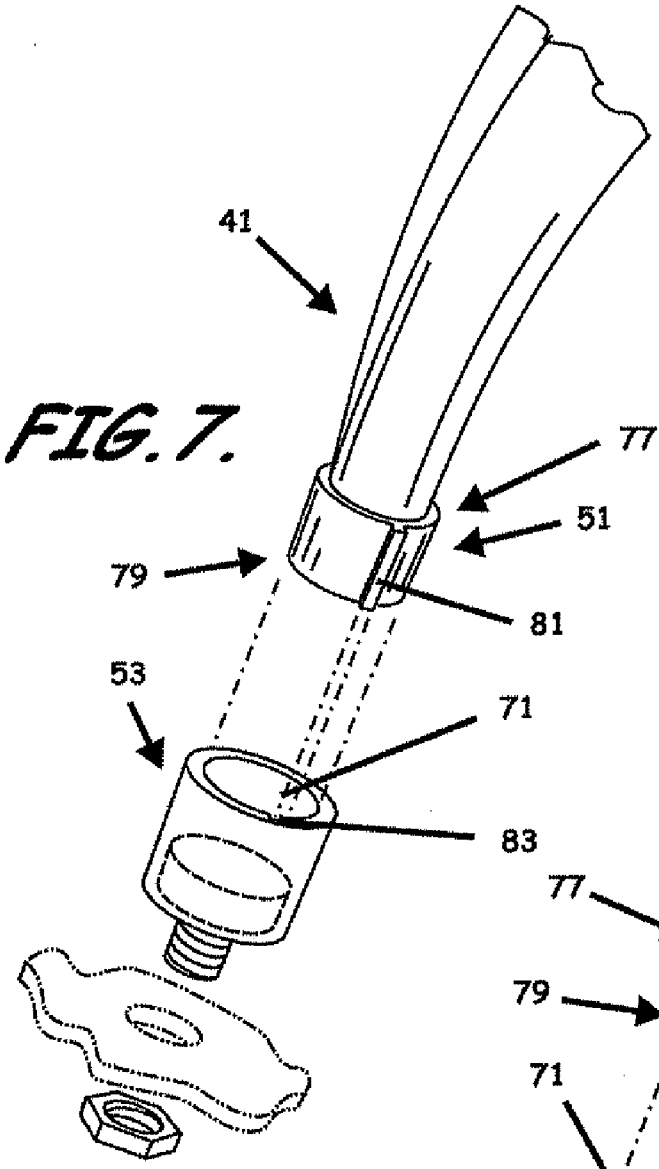
FIG. 7 is a partially exploded perspective view of a decorative element illustrating alignment means according to an embodiment of the present invention.

As shown in FIG. 7, according to an example of embodiment of the present invention, the male fittings 51 can include at least one alignment key 81 along an outer surface of the medial portion 79 of the male fitting 51. Correspondingly, the female fittings 53 can include an alignment slot 83 positioned along an inner surface of the recess 73 to receive the alignment key 81 so that when the male fitting 51 of a decorative element 41 is inserted therein, the distal end portion 45 of the decorative element 41 is properly oriented according to the artistic design. Note, although shown extending an entire length of the body of the male fitting 51, it should be understood that the alignment key 81 could be much shorter in length. Correspondingly, the alignment slot 83 need only be of a sufficient axial length needed to receive the male fitting 51. For example, if the alignment key 81 were merely in the form of a small protuberance adjacent, the distal end portion 77 of the male fitting 51, the alignment slot 83 would need only be a relatively shallow slot along the inner surface of the recess 71 adjacent the distal end portion 63 of the female fitting 53.

Figure 8:
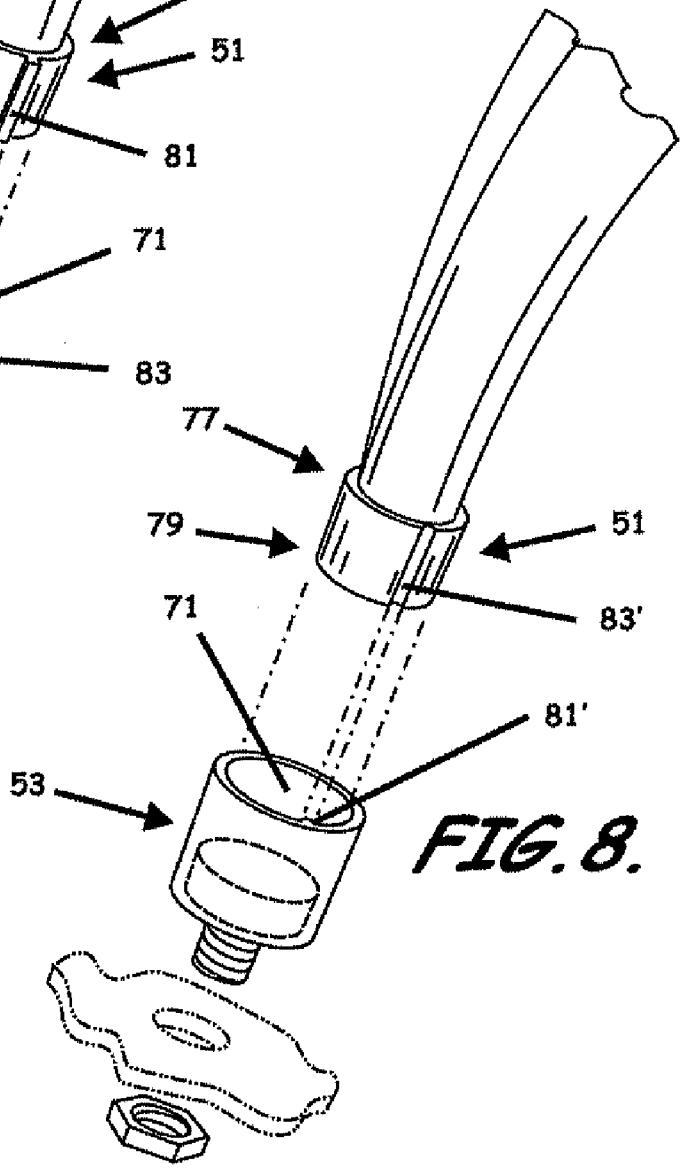
FIG. 8 is a partially exploded perspective view of a decorative element illustrating alignment means according to an embodiment of the present invention.
Figure 9:
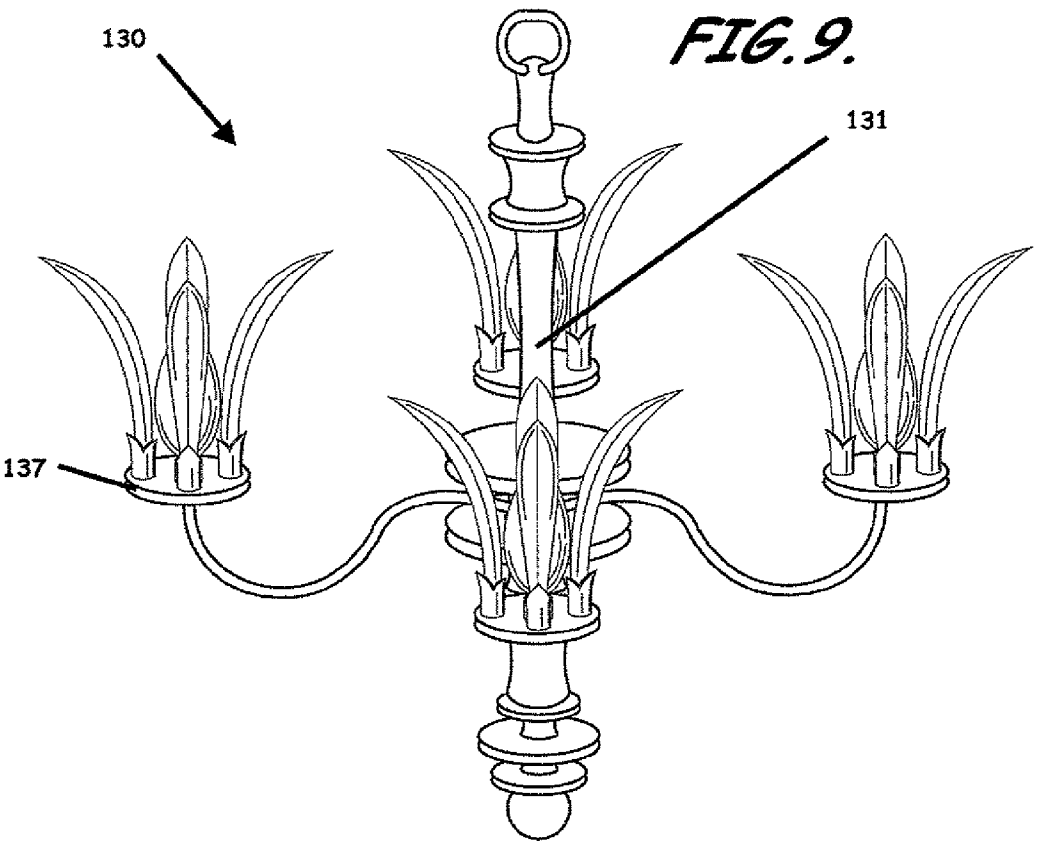
FIG. 9 is a perspective view of a lighting assembly according to an embodiment of the present invention.

FIG. 8 illustrates an example of embodiment of the present invention where the alignment key 81' is instead located along an inner surface of the recess 71 of the female fitting 53, and the alignment slot 83' is positioned along an outer surface of the medial portion 79 of the male fitting 51. Note, it should be understood that various other lengths and positions of the alignment keys 81, 81', and the corresponding alignment slots 83, 83', although not shown in the figures, nevertheless, are within the scope of the present invention.

FIG. 9-12 illustrates examples of embodiments of the present invention similar to those shown in FIGS. 1-8, whereby a lighting assembly 130 includes female fittings 153 which are at least partially, but preferably substantially, embedded within the connection platform 137 of the lighting fixture base 131.

Figure 10:
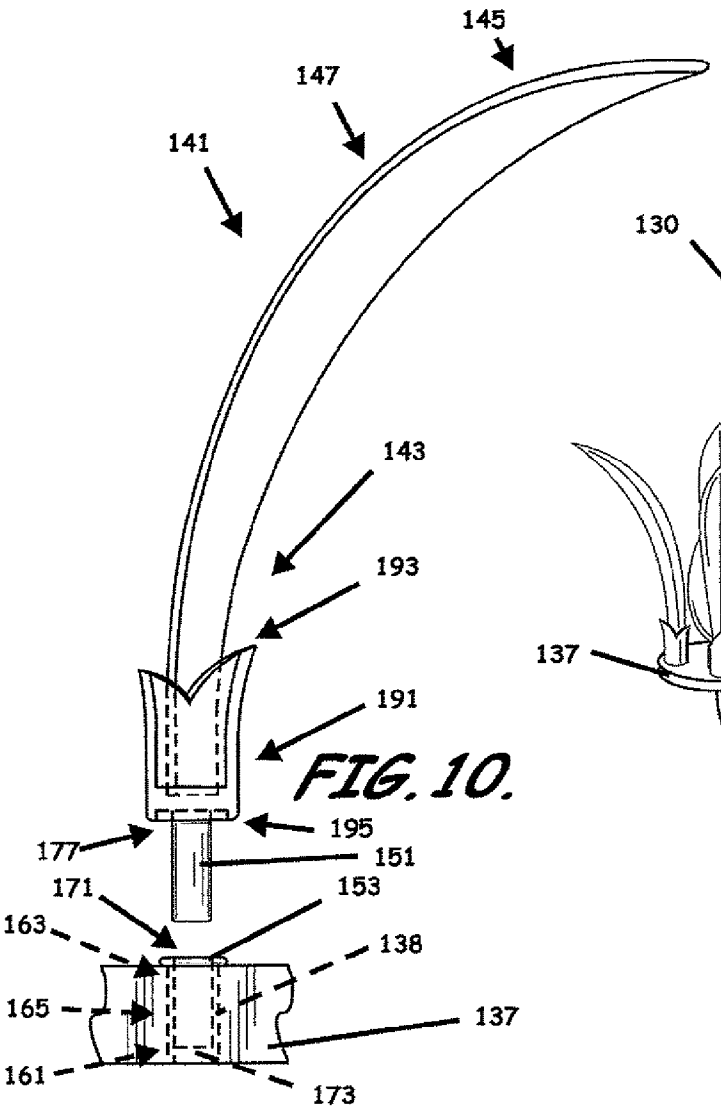
FIG. 10 is a partially exploded perspective view of a decorative element shown in FIG. 9 according to an embodiment of the present invention.

According to the example shown in FIG. 10, the proximal end portion 143 of each decorative element 141 carries or is otherwise connected to, or interfaced, with, a male fitting 151 configured to be received by a recess 171 of a corresponding female fitting 153. Rather than being attached by a fastener assembly, such as, for example, that shown in FIG. 4, the female fittings 153 can be pressed or otherwise tightly interlaced with an aperture or recess 138 formed in an outer surface of the connection platform 137 and/or extending therein, or be fused therein. As such, according to the illustrated example, the proximal end portion 161, medial portion 165, and a substantial part of the distal end portion 163, if not the complete distal end portion 163 of the female fitting 153, can extend into, and be hidden by, the surface and body of the connection platform 137. Note, according to an alternative embodiment of this exemplary configuration, the female fitting 153 can be integral with the connection platform 137, rather than being in the form of a separate element inserted therein. As noted previously, alternative methodologies of interfacing the female fitting 153 with the lighting fixture base 131 are within the scope of the present invention. Regardless, as noted above, each male fitting 151 is configured to be inserted into the recess 171 of one or more of the female fittings 153, and can be sized to slide into one or more of the female fittings 153 to form, e.g., a substantially tight connection.

According to a preferred configuration, the proximal end portion 143 of the each decorative element 141 and the distal end portion of each male fitting 151 is directly connected to axially opposite portions of a decorative skirt 191 which can function to substantially mask the male fitting 151 and/or the exposed portion of the female fitting 153 when the male fitting is inserted in the recess 171 of the female fitting 153. As such, the decorative skirt 191 can include a distal recess 193 for fixedly receiving the proximal end portion 143 of the decorative element 141, and a proximal recess 195 for fixedly receiving the distal end portion 177 of the male fitting 151. In a preferred configuration, and adhesive, epoxy, or other means known to those skilled in the art can be used to connect the decorative element 141 and male fitting 151 to the decorative skirt 191. Alternatively, the decorative skirt 191 can be integral with either or both of the decorative element 141 or the male fitting 151. Note, in an alternative configuration, the proximal end portion 143 of the each decorative element 141 can instead be directly connected to the distal end portion 177 of the male fitting 151.

Similar to the previously described exemplary embodiments of the present invention, according to this illustrated example, the recess 171 of the female fitting 153 can contain a magnet 173 typically positioned adjacent the proximal end portion 161 of the fitting 153, and the male fitting 151 can at least partially, if not completely include a ferromagnetic material so that when the male fitting 151 is inserted into the recess 171 of one of the female fittings 153, the male-female combination forms a magnetic coupling sufficient to releasably connect the decorative element 141 to the connection platform 137 of the lighting fixture base 131. Beneficially, this magnetic connection can allow for easy installation of the decorative elements 141, for example, when packaged separately during shipment, and can allow for easy removal/reinstallation for cleaning, without the need for potentially damaging tools. Further, such magnetic coupling negates the need for mechanical fasteners, and/or spring-type connection devices, which can be prone to requiring tension adjustments due to either excessive or inadequate tension, and which have a tendency to wear out. Note, it should be understood that rather than positioning the magnet 173 in the recess of the female fitting 153, as illustrated, the magnet 173 can be positioned at other locations. For example, the magnet 173 can be connected to the proximal end portion 161 of the fitting 153 outside of the recess 171, if sufficiently strong and if the fitting 153 is also made of a ferromagnetic material, or if not made of such material sufficiently strong to penetrate through the female fitting 153. Additionally, magnet 173 can instead be positioned axially in contact with the proximal most surface 175 of the male fitting 151, to be received by the recess 171 (configuration not shown).

Figures 11, 12:
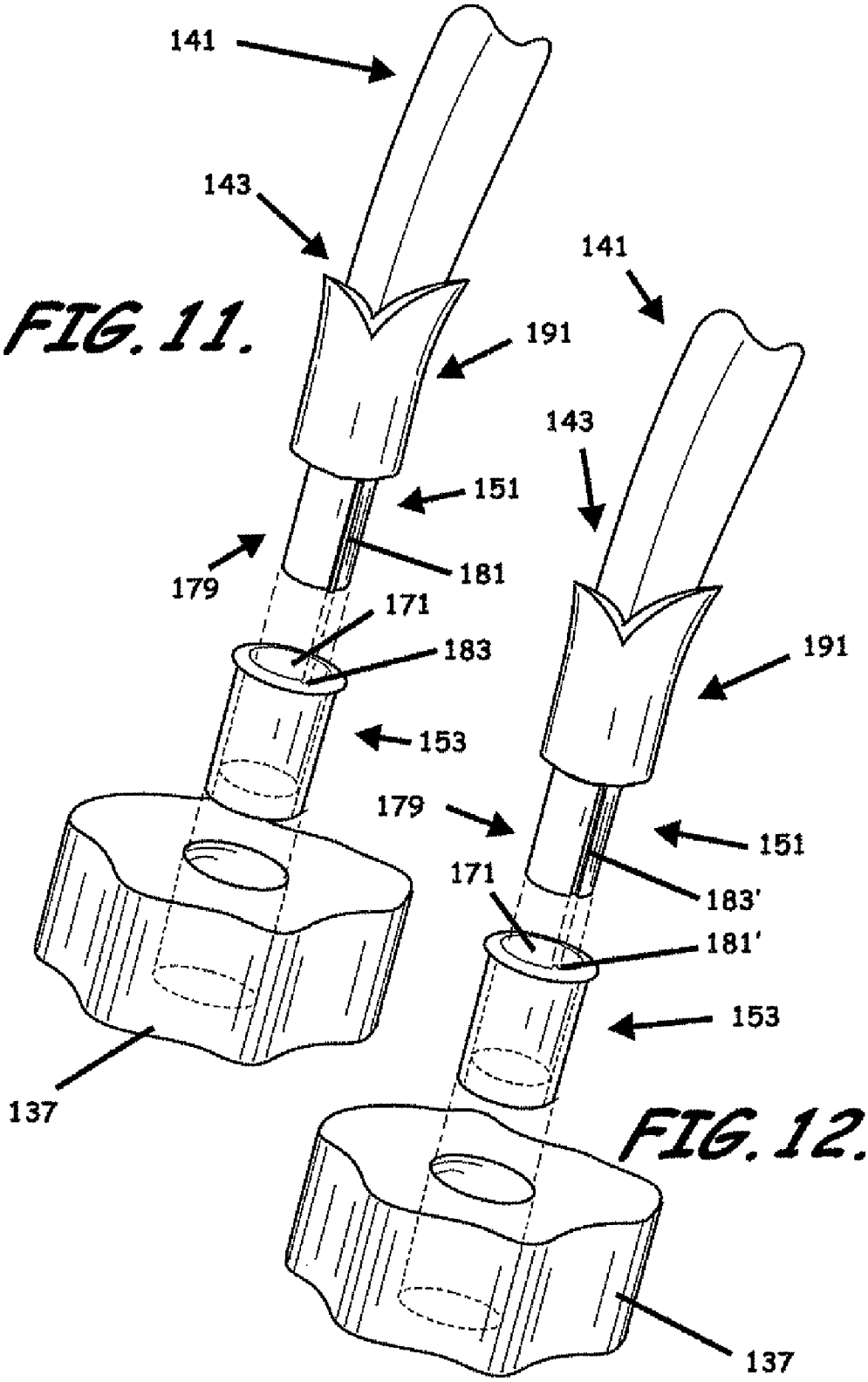
FIG. 11 is a partially exploded perspective view of a decorative element illustrating alignment means according to an embodiment of the present invention.
FIG. 12 is a partially exploded perspective view of a decorative element illustrating alignment means according to an embodiment of the present invention.

As shown in FIG. 11, similar to the configuration described with respect to FIG. 7, according to an example of embodiment of the present invention, the male fitting 151 can include at least one alignment key 181 along an outer surface of the medial portion 179 of the male fitting 151. Correspondingly, the female fittings 153 can include an alignment slot 183 positioned along an inner surface of the recess 171 to receive the alignment key 181 so that when the male fitting 151 of a decorative element 141 is inserted therein, the distal end portion 145 of the decorative element 141 (along with the proximal end portion 143 and medial portion 147) is properly oriented according to the artistic design. Note, although shown extending an entire length of the body of the male fitting 151, it should be understood that the alignment key 181 could be much shorter in length. Correspondingly, the alignment slot 183 need only be of a sufficient axial length needed to receive the male fitting 151.

As shown in FIG. 12, similar to the configuration described with respect to FIG. 8, according to an example of an embodiment of the present invention, the alignment key 181' is instead located along an inner surface of the recess 171 of the female fitting 153, and the alignment slot 1831 is positioned along an outer surface of the medial portion 179 of the male fitting 151. Note, it should be understood that various other lengths and positions of the alignment keys 181, 181', and the corresponding alignment slots 183, 183', although not shown in the figures, nevertheless, are within the scope of the present invention.

Figures 13, 14:
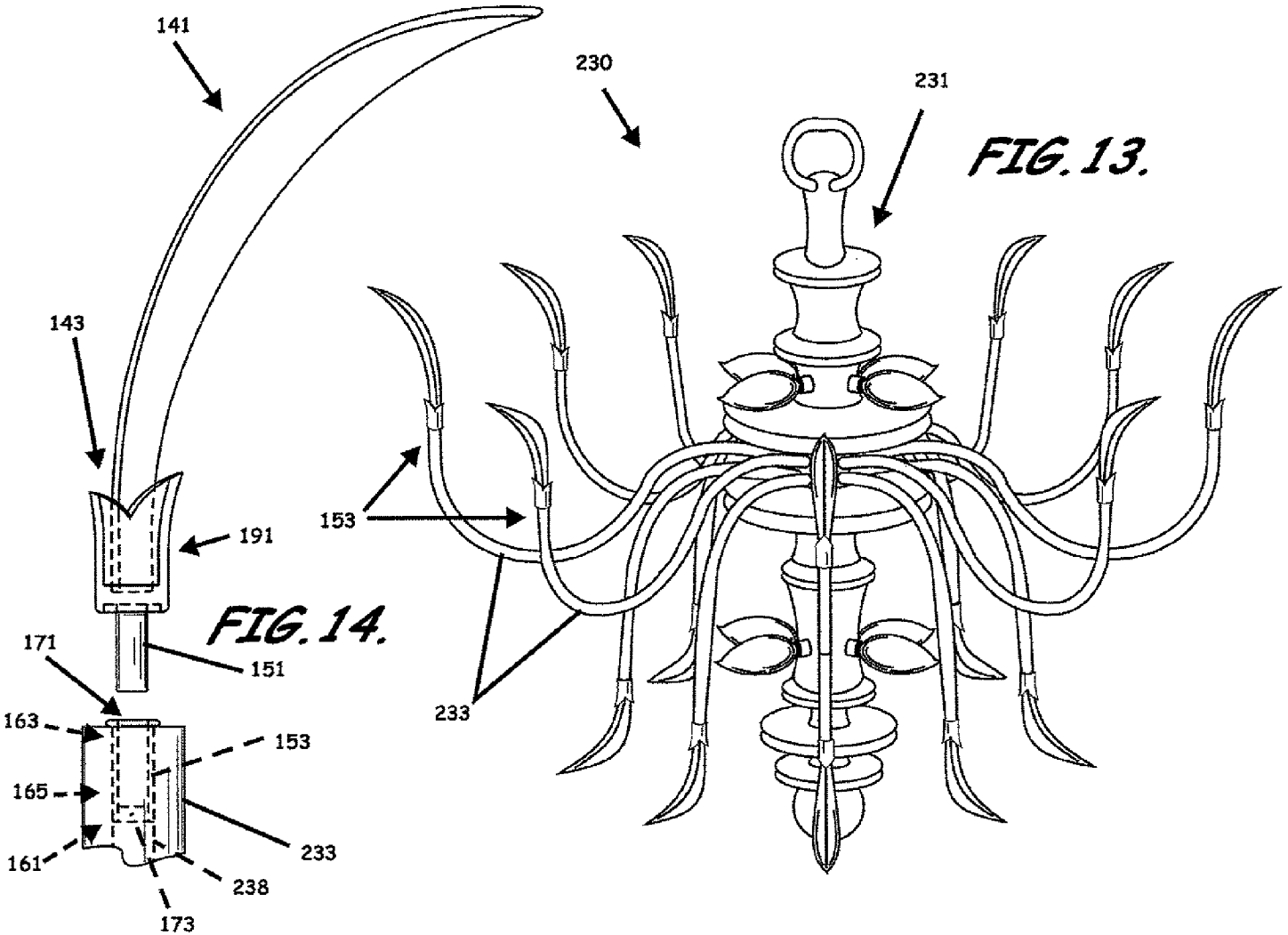
FIG. 13 is a perspective view of a lighting assembly according to an embodiment of the present invention.
FIG. 14 is a partially exploded perspective view of a decorative element shown in FIG. 13 according to an embodiment of the present invention.

FIGS. 13-14 illustrate an example of an embodiment of the present invention similar to those shown in FIGS. 9-12, whereby the lighting assembly 230 includes female fittings 153 which are at least partially, but preferably substantially, embedded in the arms 233 of the lighting fixture base 231.

According to the example shown in FIG. 14, the proximal end portion 143 of each decorative element 141 carries or is otherwise connected to, or interfaced with, a male fitting 151 configured to be received by a recess 171 of a corresponding female fitting 153, which can be pressed or otherwise tightly interfaced with an aperture or recess 238 extending into each arm 233. As such, according to the illustrated example, the proximal end portion 161, medial portion 165, and a substantial part of the distal end portion 163, if not the complete distal end portion 163 of the female fitting 153, can extend into, and be hidden by, the surface and body of the arms 233. Note, according to an alternative embodiment of this exemplary configuration, the female fitting 153 can be integral with the connection platform 137, rather than being in the form, of a separate element inserted therein.

Similar to the previously described exemplary embodiments of the present invention, according to this illustrated example, the proximal end portion 143 of the each decorative element 141 and the distal end portion of each male fitting 151 is directly connected to axially opposite portions of a decorative skirt 191 which can function to substantially mask the male fitting 151 and/or the exposed portion of the female fitting 153 when the male fitting is inserted in the recess 171 of the female fitting 153. Also similar to the previously described exemplary embodiments of the present invention, according to this illustrated example, the recess 171 of the female fitting 153 can contain a magnet 173 typically positioned adjacent the proximal end portion 163 of the fitting 153, and the male fitting 151 can at least partially, if not completely, include a ferromagnetic material so that when the male fitting 151 is inserted into the recess 171 of one of the female fittings 153, the male-female combination forms a magnetic coupling sufficient to releasably connect the decorative element 141 to the arm 233 of the lighting fixture base 231.

Figure 15:
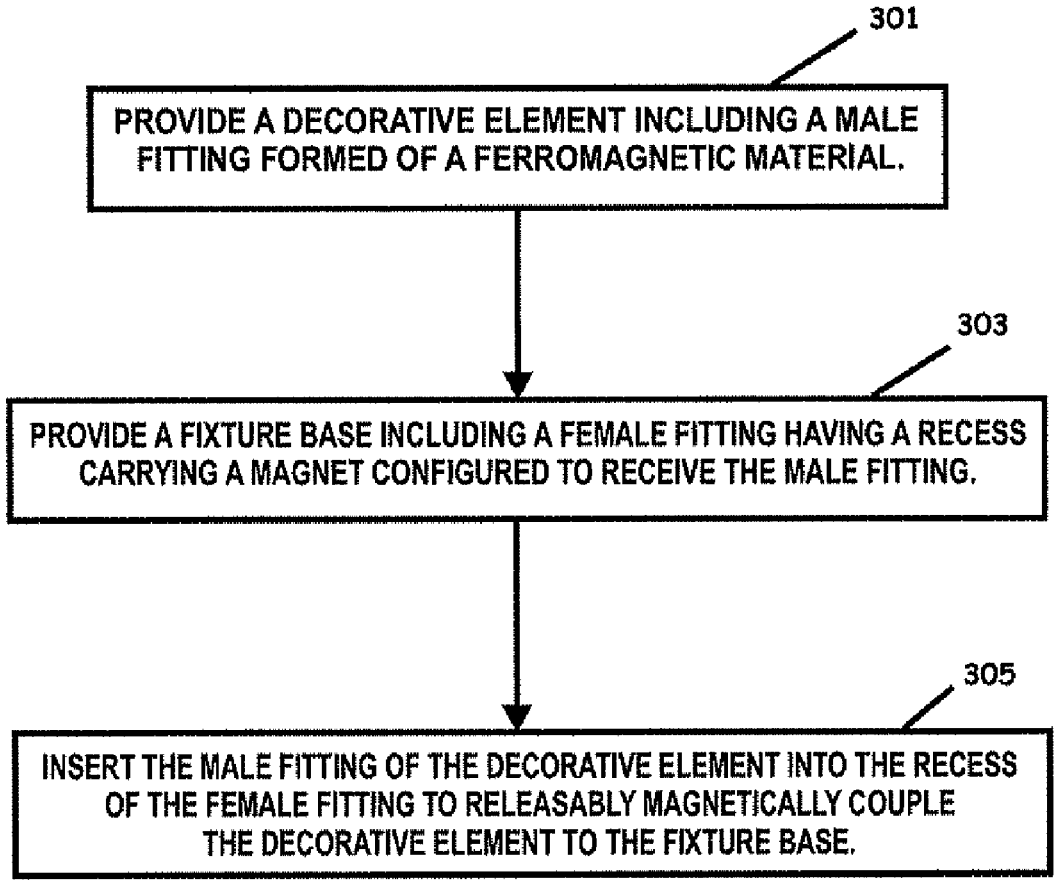
FIG. 15 is a block flow diagram illustrating a method of forming a lighting fixture assembly according to an embodiment of the present invention.

As shown in FIG. 15, embodiments of the present invention also include a method of forming a lighting assembly such as, for example, lighting assembly 30, 130, 230. An example of a method of forming lighting assembly 130, for example, includes providing one or more decorative elements 141 connected to or otherwise including a male fitting 151 formed of a ferromagnetic material (block 301), and providing a fixture base 131 containing, connected to, or otherwise including a female fitting 153 having a recess 171 carrying a magnet 173 and configured to receive the male fitting 151 (block 303). The method can also include inserting the male fitting 151 of the decorative element 141 into the recess 171 of the female fitting 153 to releasably magnetically couple the decorative element 151 to the fixture base 131 (block 305). If one or more of the male fittings 151 each include an alignment, key 181 and one or more of the female fittings 153 include a corresponding alignment slot 183 (see, e.g., FIG. 11), the step of inserting the male fitting 151 into the recess 171 of the female fitting 153 can include aligning the alignment key 181 of the male fitting 151 with the alignment slot 183 of the female fitting 153 to orient the decorative element 141 in a preselected orientation. Alternatively, if one or more of the male fitting 151 each include an alignment slot 183' and one or more of the female fittings 153 each include an alignment key 181' (see, e.g., FIG. 12), the step of inserting the male fitting 151 into the recess 171 of the female fitting 153 can include aligning the alignment slot 183' of the male fitting 151 with the alignment key 18T of the female fitting 153 to orient the decorative element 141 in the preselected orientation.

In the drawings and specification, them have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification. For example, although primarily described with respect to a fixture for carrying lights, it should be understood to those skilled in the art that the magnetic coupling fittings and decorative element can be employed on non-light producing fixtures, and thus, applications with respect to such fixtures are within the scope of the present invention. Also for example, although the coupling magnet was shown positioned within a recess of the female fitting, the coupling magnet could be connected to the male fitting. Further, although each decorative element was described as connected to a male fitting configured to interface with female fittings contained within or otherwise carried by a fixture base, the decorative elements can instead include the female fitting, with the male fittings being carried by the fixture base.

That claimed is:

1. A lighting assembly comprising:

a lighting fixture base;

a plurality of elongate decorative elements each having a proximal end portion, a distal end portion, and a medial portion extending therebetween;

a plurality of male fittings each connected to the proximal end portion of a separate one of the plurality of elongate decorative elements, each male fitting configured to be inserted into a female fitting, each male fitting comprising a ferromagnetic material;

a corresponding plurality of female fittings each connected to separate portions of the lighting fixture base, each female fitting including a proximal end portion, a distal end portion, and a medial portion extending therebetween, the distal end portion and the medial portion each including portions of a recess configured to receive substantial portions of the male fitting of a separate one of the plurality of male fittings; and a plurality of magnets, each magnet positioned adjacent the proximal end portion of a separate one of the plurality of female fittings, each male fitting magnetically coupled to a corresponding one of the plurality of female fittings when inserted therein to releasably connect a respective separate one of the plurality of elongate decorative elements to the lighting fixture base.

2. A lighting assembly as defined in claim 1, wherein the proximal end portion of each of the plurality of female fittings also include portions of the recess to define a magnet housing; and wherein each of the plurality of magnets is positioned in the magnet housing of a separate one of the plurality of female fittings.

3. A lighting assembly as defined in claim 2, wherein each of the plurality of female fittings substantially extend through separate outer surface portions of the lighting fixture base and are substantially contained within respective separate portions of the lighting fixture base associated therewith.

4. A lighting assembly as defined in claim 2, wherein the first fitting includes a proximal end portion, a distal end portion, and a medial portion extending therebetween, the lighting assembly further comprising:

a plurality of decorative skirts each containing at least portions of the proximal end portion of one of the plurality of decorative elements and at least portions of the distal end portion of a respective one of the plurality of male fittings to maskingly interface the one of the plurality of decorative elements with the respective one of the plurality of male fittings.

5. A lighting assembly as defined in claim 1, wherein each male fitting includes a proximal end portion, a distal end portion, and a medial portion extending therebetween, each of the proximal end portion, the distal end portion, and the medial portion including an outer surface;

wherein at least one of the outer surface of the distal end portion, the outer surface of the proximal end portion, and the outer surface of the medial portion of each male fitting includes a protuberance defining an alignment key extending outwardly therefrom; and wherein each female fitting includes an alignment slot configured to interface with the alignment key of a respective one of the plurality of male fittings to orient a corresponding one of the plurality of elongate decorative elements in a preselected orientation when the respective male fitting is inserted therein.

6. A lighting assembly as defined in claim 5, wherein the alignment slot of the each female fitting includes an elongate slot extending along inner surface portions of the proximal end portion, the distal end portion, and the medial portion of the respective female fitting.

7. A lighting assembly as defined in claim 1, wherein the proximal end portion, the distal end portion, and the medial portion of each female fitting includes an inner surface;

wherein at least one of the inner surface of the distal end portion, the inner surface of the proximal end portion, and the inner surface of the medial portion of each female fitting includes a protuberance defining an alignment key extending inwardly therefrom; and wherein each male fitting includes an alignment slot configured to interface with the alignment key of a respective one of the plurality of female fittings to orient a corresponding one of the plurality of elongate decorative elements in a preselected orientation when the respective male fitting is inserted therein.

8. A lighting assembly as defined in claim 7, wherein the each alignment slot of each male fitting includes an elongate slot extending along outer surface portions of the proximal end portion of the respective male fitting.

9. A lighting assembly as defined in claim 1, wherein each male fitting includes a proximal end portion, a distal end portion, and a substantially cylindrical medial portion extending therebetween, each of the proximal end portion, the distal end portion, and the medial portion including an outer surface;

wherein the medial portion of the each female fitting includes a substantially cylindrical inner surface so that the portion of the recess of each female fitting extending through the medial portion thereof is substantially cylindrical; and wherein a diameter of the outer surface of the medial portion of each male fitting is sized to substantially match a diameter of the recess of each female fitting extending through the medial portion thereof to radially immobilize the decorative element when inserted therein, while not preventing axial movement.

10. A lighting assembly as defined in claim 9, wherein each male fitting is configured so that each male fitting can be manually inserted into and manually extracted from the recess of at least one of the plurality of female fittings without the use of mechanical tools.

11. A lighting assembly comprising:

a decorative element having a proximal end portion, a distal end portion, and a medial portion extending therebetween, the proximal end portion of the decorative element including a first fitting connected thereto and comprising a ferromagnetic material; and a lighting fixture base including a second fitting connected thereto, the second fitting having a proximal end portion, a distal end portion, and a medial portion extending therebetween, and including a recess configured to receive at least portions of the first fitting, the proximal end portion of the second fitting including portions of the recess to define a magnet housing, the second fitting carrying a magnet, the magnet positioned in the magnet housing of the second fitting and positioned to magnetically couple the second fitting with the first fitting when the first fitting is inserted into the recess of the second fitting to thereby releasably connect the decorative element to the fixture base.

12. A lighting assembly as defined in claim 11, wherein the second fitting substantially extends through an outer surface of the lighting fixture base and is substantially contained within the lighting fixture base.

13. A lighting assembly as defined in claim 11, wherein the first fitting includes a proximal end portion, a distal end portion, and a medial portion extending therebetween, the lighting assembly further comprising:

a decorative skirt containing at least portions of the proximal end portion of the decorative element and at least portions of the distal end portion of the first fitting to maskingly interface the decorative element with the first fitting.

14. A lighting assembly as defined in claim 11, wherein the first fitting includes a proximal end portion, a distal end portion, and a medial portion extending therebetween, each of the proximal end portion, the distal end portion, and the medial portion including an outer surface;

wherein at least one of the outer surface of the distal end portion, the outer surface of the proximal end portion, and the outer surface of the medial portion of the first fitting includes a protuberance extending outwardly therefrom; and wherein the second fitting includes an alignment slot configured to interface with the protuberance of the first fitting to orient the elongate decorative element in a preselected orientation when the first fitting is inserted therein.

15. A lighting assembly as defined in claim 11, wherein each of the proximal end portion, the distal end portion, and the medial portion includes an inner surface;

wherein at least one of following includes a protuberance extending inwardly therefrom: the inner surface of the distal end portion, the inner surface of the proximal end portion, and the inner surface of the medial portion of the second fitting; and wherein the first fitting includes an alignment slot configured to interface with the protuberance of the second fitting to orient the elongate decorative element in a preselected orientation when the first fitting is inserted therein.

16. A lighting assembly comprising:

a decorative element having a proximal end portion, a distal end portion, and a medial portion extending therebetween;

a first fitting connected to the proximal end portion of the decorative element and comprising a ferromagnetic material; and a second fitting configured to be connected to a lighting fixture base, the second fitting having a proximal end portion, a distal end portion, and a medial portion extending therebetween and including a recess configured to receive at least portions of the first fitting, the proximal end portion of the second fitting including portions of the recess to define a magnet housing, the second fitting carrying a magnet, the magnet positioned in the magnet housing of the second fitting and positioned to magnetically couple the second fitting with the first fitting when the first fitting is inserted into the recess of the second fitting to thereby releasably connect the decorative element to the fixture base.

17. A lighting assembly as defined in claim 16, wherein the second fitting is positioned to substantially extend through an outer surface of the fixture base and is substantially contained within the fixture base.

18. A lighting assembly as defined in claim 16, wherein the first fitting includes a proximal end portion, a distal end portion, and a medial portion extending therebetween, the lighting assembly further comprising:

a decorative skirt containing at least portions of the proximal end portion of the decorative element and at least portions of a distal end portion of the first fitting to maskingly interface tire decorative element with the first fitting.

19. A lighting assembly as defined in claim 16, wherein the first, fitting includes a proximal end portion, a distal end portion, and a medial portion extending therebetween, each of the proximal end portion, the distal end portion, and the medial portion including an outer surface;

wherein at least one of the outer surface of the distal end portion, the outer surface of the proximal end portion, and the outer surface of the medial portion of the first fitting includes a protuberance extending outwardly therefrom; and wherein the second fitting includes an alignment slot configured to interface with the protuberance of the first fitting to orient the elongate decorative element in a preselected orientation when the first fitting is inserted therein.

20. A lighting assembly as defined in claim 16, wherein the second fitting includes a proximal end portion, a distal end portion, and a medial portion extending therebetween, each of the proximal end portion, the distal end portion, and the medial portion including an inner surface;

wherein at least one of the inner surface of the distal end portion, the inner surface of the proximal end portion, and the inner surface of the medial portion of the second fitting includes a protuberance extending inwardly therefrom; and wherein the first fitting includes an alignment slot configured to interface with the protuberance of the second fitting to orient the elongate decorative element in a preselected orientation when the first fitting is inserted therein.

21. A method of forming a lighting assembly, the method comprising the steps of:

providing a decorative element having a proximal end portion, a distal end portion, and a medial portion extending therebetween, the proximal end portion of the decorative element including a first fitting connected thereto and comprising a ferromagnetic material;

providing a lighting fixture base including a second fitting connected thereto and including a recess configured to receive at least portions of the first fitting, the second fitting carrying a magnet positioned to magnetically couple the second fitting with the first fitting when the first fitting is inserted therein and including an alignment slot configured to interface with an alignment key extending from an outer surface of the first fitting; and inserting the first fitting into the recess of the second fitting to releasably connect the decorative element to the fixture base, aligning the alignment key of the first fitting with the alignment slot of the second fitting to orient the elongate decorative element in a preselected orientation.

22. A method of forming a lighting assembly, the method comprising the steps of:

providing a decorative element having a proximal end portion, a distal end portion, and a medial portion extending therebetween, the proximal end portion of the decorative element including a first fitting connected thereto and comprising a ferromagnetic material and including an alignment slot configured to interface with an alignment key extending from an outer surface of the second fitting; and providing a lighting fixture base including a second fitting connected thereto and including a recess configured to receive at least portions of the first fitting, the second fitting carrying a magnet positioned to magnetically couple the second fitting with the first fitting when the first fitting is inserted therein;

inserting the first fitting into the recess of the second fitting to releasably connect the decorative element to the fixture base, aligning the alignment slot of the first fitting with the alignment key of the second fitting to orient the elongate decorative element in a preselected orientation.

* * * * *

UNITED STATES PATENT AND TRADEMARK OFFICE

CERTIFICATE OF CORRECTION

PATENT NO. : 7,891,848 B2
APPLICATION NO. : 12/324587
DATED : February 22, 2011
INVENTOR(S) : Jacob Sperling It is certified that error appears in the above-identified patent and that said Letters Patent is hereby corrected as shown below:

Column 1, line 63, delete “band” and insert --hand--

Column 2, line 3, delete “tire” and insert --the--

Column 4, line 25, delete “tire” and insert --the--

Column 5, line 45, delete “63” and insert --61--

Column 6, line 32, delete “73” and insert --71--

Column 7, line 1, delete “interlaced” and insert --interfaced--

Column 8, line 26, delete “1831” and insert --183--

Column 8, line 65, delete “163” and insert --161--

Column 9, line 33, delete “18T” and insert --181--

Signed and Sealed this
Thirty-first Day of May, 2011

David J. Kappos

David J. Kappos
*Director of the United States Patent and Trademark Office*